United States Patent [19]

Thorp

[11] 3,946,172

[45] Mar. 23, 1976

[54] LATCHING APPARATUS

[75] Inventor: Peter M. Thorp, Lydbrook, England

[73] Assignee: Rank Xerox Ltd., London, England

[22] Filed: Dec. 12, 1974

[21] Appl. No.: 532,279

[52] U.S. Cl. ..... 200/44

[51] Int. Cl.[2] ..... H01H 9/28

[58] Field of Search ..... 200/42 R, 42 T, 44; 70/203

[56] References Cited

UNITED STATES PATENTS 3,497,646 2/1970 Pollak ..... 200/42 R

*Primary Examiner*—Herman J. Hohauser

*Attorney, Agent, or Firm*—H. Fleischer; J. J. Ralabate; C. A. Green

[57] ABSTRACT

A latching apparatus including a housing having an aperture therein for receiving a key. Insertion of the key into the housing aperture rotates an actuating member from an open position to a closed position.

10 Claims, 5 Drawing Figures

LATCHING APPARATUS

The foregoing abstract is neither intended to define the invention disclosed in the specification, nor is it intended to be limiting as to the scope of the invention in any way.

BACKGROUND OF THE INVENTION

This invention relates generally to a latching apparatus and more particularly concerns an apparatus for actuating electrical switches or locking members such as doors or windows.

In a typical electrical switch, an electrical conducting path between two contacts is made or broken according to the position of the actuating mechanism. Hereinbefore, mechanisms of this type could easily be operated by a pencil or finger so that they were not secure and might be energized by someone without a special key. Moreover, a locking mechanism of this type is frequently left in the closed position with the key withdrawn therefrom. It would be highly desirable to automatically return the locking mechanism to the open position as the key is removed therefrom. Thus, the locking mechanism would not remain in the actuated condition unless the key was present therein. This would provide a visual indication to the operator of the state of the locking mechanism.

Accordingly, it is a primary object of the present invention to improve latching mechanisms utilized as an electrical switch for making or breaking a conductive path between two electrical contacts, or, in lieu thereof, as a door or window lock.

SUMMARY OF THE INVENTION

Briefly stated, and in accordance with the present invention, there is provided a latching apparatus.

Pursuant to the features of this invention, the latching apparatus includes a key member, a housing, and an actuating member. An aperture is located in the housing and arranged to receive the key member therein. The actuating member is mounted rotatably in the housing and has a recessed portion therein for receiving the key member. When the actuating member is in the open position, the recessed portion therein is substantially aligned with the aperture in the housing. In the open position, the key member may be inserted into the housing aperture to engage the recessed portion of the actuating member. Engagement of the actuating member by the key member rotates the actuating member from the open position to the closed position. In the closed position, a portion of the actuating member blocks the aperture in the housing with the key member secured therein and extending outwardly therefrom.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
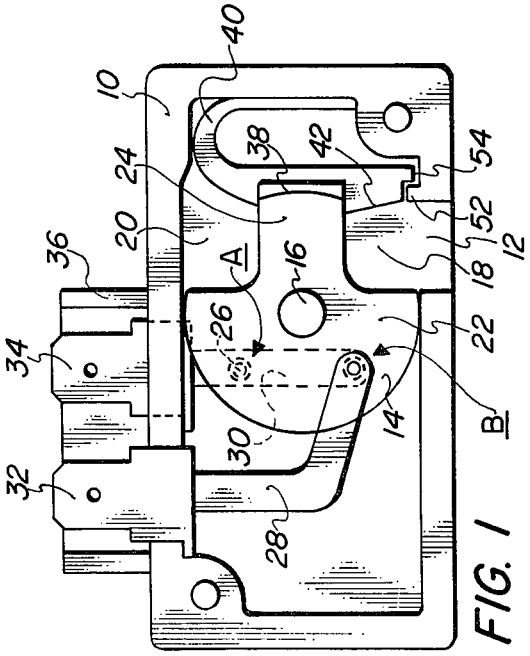
FIG. 1 is a sectional plan view illustrating the latching apparatus of the present invention.

For a general understanding of the illustrated latching apparatus, continued reference is had to the drawings wherein like reference numerals have been used throughout to designate like elements. FIG. 1 depicts the latching apparatus of the present invention employed as a switch to electrically connect a pair of spaced terminals. Although the latching apparatus of the present invention is particularly well adapted for use as a switch, it should become evident from the following discussion that it is equally well suited for use in a wide variety of devices and is not necessarily limited in its application to the particular embodiment shown herein.

Figure 2:
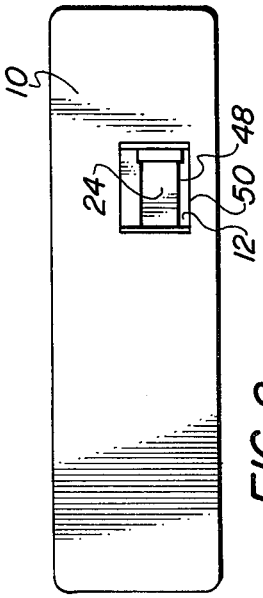
FIG. 2 is an elevational view of the FIG. 1 latching apparatus.

Turning now to FIGS. 1 and 2, the latching apparatus includes a substantially rectangular housing 10 preferably made from an insulating material such as a molded plastic material and having a key aperture 12 in one wall thereof. Positioned within housing 10 is an actuator member 14. Actuator member 14 is similar to a Geneva device. Shaft 16, in housing 10, secures actuating member 14 rotatably therein. Preferably, actuating member 14 is provided with two cut-out sections or recessed portions, generally designated by the reference numerals 18 and 20, respectively. Preferably, actuating member 16 is made from an insulating member having a semi-circular portion 22 with a rectangular portion 24 extending outwardly therefrom. An electrically conducting disc 26 is mounted in the semi-circular portion 14 and extends through the thickness thereof. A pair of electrical contacts 28 and 30, are positioned such that semi-circular portion 22 is interposed therebetween. In the non-actuated position as shown by the reference letter A, disc 26 is positioned to contact only one of the electrical contacts, i.e., contact 30. Contrawise, in the closed position disc 26 is interposed between and in contact with electrical contacts 28 and 30 forming an electrically conductive path therebetween. Electrical contacts 28 and 30 are connected to terminals 32 and 34 on the exterior of housing 10. Insulating shield 36 surrounds terminals 32 and 34 forming a recessed socket for receiving a plug therein. In the open or non-actuated position, rectangular portion 24 of actuating member 14 mates with recessed portion 38 of leaf spring 40. Insertion of the key (FIGS. 3 through 5, inclusive) in aperture 12 disengages leaf spring 40 from rectangular portion 24 of actuating member 14 permitting the relatively free rotation thereof from the opened position to the closed position.

As shown in FIGS. 1 and 2, the latching apparatus is in its non-actuated position with cut-out section 18 adjacent aperture 12. Disc 26 is located remote from contact 28, isolating terminal 32 from terminal 34. Cut-out section 20 serves to cooperate with cut-out section 18 to define rectangular portion 24 extending outwardly from semi-circular portion 22 of actuating member 14. Rectangular portion 24 is arranged to mate with recess 38 of leaf spring 40 in the non-actuated position. Leaf spring 40 has a tapered surface 42 adjacent to recess 38. Insertion of the key member through aperture 12 causes tapered surface 42 to be depressed releasing rectangular portion 24 from recessed portion 38, thereby permitting actuating member 14 to rotate. As the key is inserted further through aperture 12, it engages the wall of rectangular portion 24 causing actuating member 14 to rotate about shaft 16, thereby interposing conducting disc 28 between contacts 28 and 30. Thus, in the actuated position an electrically conductive path is formed between terminals 32 and 34. Rotation of actuating member 14 results in cut-out section 18 being misaligned from aperture 12 while semi-circular portion 22 extends across aperture 12. In this position, i.e., the closed or actuated position, the key member is retained in the latching apparatus.

Figure 3:
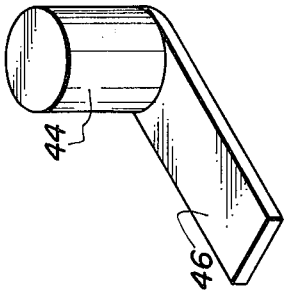
FIG. 3 is a perspective view depicting the key employed in the FIG. 1 latching apparatus.
Figure 4:
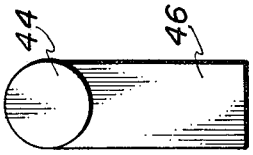
FIG. 4 is a plan view of the FIG. 1 key.
Figure 5:
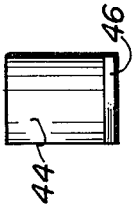
FIG. 5 is an elevational view of the FIG. 1 key.

Referring now to FIG. 3 through 5, inclusive, the special key member employed as part of the latching apparatus hereinbefore described is shown therein schematically. The key includes an elongated cylindrical rod 44 secured to one marginal portion of blade 46. The longitudinally extending axis of rod 44 is substantially normal to the surface of blade 46 and parallel to the thickness thereof. The diameter of rod 44 is substantially equal to the width of blade 46.

Referring once again to FIG. 2, the height of aperture 12 is sufficient to permit passage of the marginal region of the key having rod 44 secured to blade 44 therethrough. Surface 48 of actuating member 14 is spaced from the opposed surface 50 of aperture 12 a distance intermediate the thickness of blade 46 and the sum of the thickness of blade 46 and the height of rod 44. In this manner, blade 46 may be interposed between actuating member 14 and housing 10 when actuating member 14 has rotated to the closed position. At this time, the key member is secured therein and may not be removed therefrom.

In the closed position, the key member is retained in the latching apparatus since rod 44 is captured in cut-out section 18 with blade 46 being interposed between surface 48 of actuating member 14 and surface 50 of housing 10. When the key member is withdrawn from aperture 12 of housing 10, actuating member 14 returns therewith to the non-actuated or open position, as shown in FIG. 1. When the actuating member 14 is returned to the non-actuated position, rectangular portion 24 once again is positioned in alignment with recess 38 of leaf spring 40. Thus, when the key member is withdrawn from cut-out section 18, leaf spring 40 is no longer depressed and recessed portion 38 thereof engages rectangular portion 24 of actuating member 14. This prevents actuating member 14 from rotating in the absence of the key.

With the configuration described hereinbefore, actuating member 14 can only be rotated by a key having a blade sufficiently thin to pass between surface 48 of actuating member 14 and surface 50 of housing 10. In addition, the key member must have an upturned portion complementary in configuration to that of cut-out portion 18 so as to engage rectangular portion 24 of actuating member 14, thereby rotating it from the open position to the closed position. By shaping rod 44 complementary to the configuration of cut-out section 18, there is little lost motion between actuating member 14 and the key member. Leaf spring 40 is prevented from moving too close to actuating member 14 by a lug 52 on housing 10 which engages end 54 of spring 40.

In operation, blade 46 of the key is held by the user. The key is inserted into aperture 12 until rod 44 engages rectangular portion 24 of actuating member 14. As rod 44 passes into aperture 12 it depresses spring 40 by engaging tapered surface 42 to free rectangular portion 24. The operator continues to insert the key into aperture 12 while grasping blade 46 until rod 44 engages rectangular portion 24. This causes actuating member 14 to rotate counterclockwise. The operator continues to insert the key pressing rod 44 against rectangular portion 24 to continue the rotation of actuating member 14 until semi-circular portion 22 blocks aperture 12. At this time, blade 46 is interposed between the lower surface of semi-circular portion 22 and surface 50 of housing 10 with rod 44 being located in cut-out region 18. Actuating member 14 has now rotated such that conducting disc 26 is interposed between contacts 28 and 30 forming an electrical connection between terminals 32 and 34. Moreover, the key is locked in position in that cut-out portion 18 retains rod 44 while blade 46 is interposed between surface 50 and the opposed surface of semi-circular portion 22. Removal of the key rotates actuating member 14 clockwise positioning cut-out portion 18 in aperture 12 permitting rod 44 to be removed from housing 10.

Although the latching apparatus hereinbefore described has been disclosed in the form of an electrical switch, actuating member 14 can be used to operate a conventional locking device such as a door or window lock, amongst others. In embodiments of this type actuating member 14 would include a catch adapted to secure the door or lock preventing the movement thereof. In addition, actuating member 14 may be provided with an indent which is engaged by a spring catch adapted to retain actuating member 14 in its actuated position. The foregoing is particularly useful when the latching apparatus is employed as a door or window lock.

In recapitulation, it is evident that the apparatus of the present invention may be employed to electrically connect a pair of spaced terminals as well as locking a door or window. The foregoing apparatus employs a special key arranged to be retained therein when the actuating member thereof is moved from the opened position to the closed position. In this manner the actuating member may only be positioned in the closed position with the key member secured therein. At all other times, the actuating member is disposed in the open position.

It is, therefore, evident that there has been provided in accordance with the present invention a latching apparatus that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A latching apparatus, including:

a key member;

a housing having an aperture therein to receive said key member, said housing defining a chamber in communication with the aperture therein; and an actuating member mounted rotatably in the chamber of said housing and having a recessed portion therein for receiving said key member, said actuating member being rotated from an opened position with the recessed portion therein substantially aligned with the aperture in said housing to a closed position wherein a portion of said actuating member substantially blocks the aperture in said housing, said key member being arranged to engage the recessed portion of said actuating member to rotate said actuating member from the opened position to the closed position securing said key member in the aperture of said housing with a portion thereof extending outwardly therefrom so that removal of said key member returns said actuating member to the opened position.

2. An apparatus as recited in claim 1, wherein said key member includes:

a blade; and a rod secured to one of the marginal regions of said blade and extending substantially normal to the surface of said blade, said rod cooperating with the recessed portion of said actuating member to rotate said actuating member from the opened position to the closed position with said blade being interposed between said housing and said actuating member in the closed position.

3. An apparatus as recited in claim 2, further including means for retaining said actuating member in the opened position, said retaining means being disengageable from said actuating member by insertion of said key member through the aperture in said housing.

4. An apparatus as recited in claim 3, wherein the shape of the recessed portion of said actuating member complements the shape of said rod.

5. An apparatus as recited in claim 4, wherein said retaining means includes resilient means for returning said retaining means into engagement with said actuating member upon withdrawal of said key member from the aperture in said housing and the return of said actuating member to the opened position.

6. An apparatus as recited in claim 5, further including a pair of electrical contacts spaced from one another, said actuating member electrically connecting said contacts to one another in the closed position and isolating said contact from one another in the opened position.

7. An apparatus as recited in claim 6, wherein said actuating member includes:

an insulating member interposed between said pair of contacts when said actuating member rotates to the opened position to isolate said contacts from one another; and a conducting member interposed between said pair of contacts when said actuating member rotates to the closed position electrically connecting said contacts to one another.

8. An apparatus as recited in claim 7, wherein:

said insulating member includes a substantially semi-circular portion having a substantially rectangular portion extending outwardly therefrom and arranged to engage said resilient means in the opened position; and said conducting member includes a disc mounted in said semi-circular portion of said insulating member and extending therethrough so as to be interposed between said pair of contacts in the closed position to electrically connect said pair of contacts to one another.

9. An apparatus as recited in claim 8, wherein said resilient means includes a leaf spring having a substantially rectangular recess therein adapted to mate with the rectangular portion of said insulating member in the opened position.

10. An apparatus as recited in claim 9, wherein the height of the aperture in said housing is greater than the sum of the thickness of said blade and the height of said rod secured thereto enabling said rod to pass therein to engage the rectangular portion of said insulating member in the opened position, and the space between one surface of the aperture of said housing and the surface of said insulating member opposed therefrom is intermediate the thickness of said blade and the sum of the thickness of said blade and the height of said rod secured thereto enabling said blade to be interposed between said housing and insulating member when said actuating member rotates to the closed position.

* * * * *